US006631684B2

(12) United States Patent
Kang

(10) Patent No.: US 6,631,684 B2
(45) Date of Patent: Oct. 14, 2003

(54) ROCK BLASTING METHOD USING AIR BLADDERS EMBEDDED IN LOADING LAYERS

(76) Inventor: Dae Woo Kang, Singaegum LG Apt. 216-1702, 455 Gaegum-dong, Busanjin-gu, Busan 614-751 (KR)

( * ) Notice: Subject to any disclaimer, the term of this patent is extended or adjusted under 35 U.S.C. 154(b) by 0 days.

(21) Appl. No.: 09/973,160

(22) Filed: Oct. 4, 2001

(65) Prior Publication Data

US 2002/0050222 A1 May 2, 2002

Related U.S. Application Data

(63) Continuation-in-part of application No. 09/512,192, filed on Feb. 24, 2000, now Pat. No. 6,330,860.

(30) Foreign Application Priority Data

Sep. 16, 1999 (KR) ..... 1999-39907

(51) Int. Cl.[7] ..... F42B 3/08

(52) U.S. Cl. ..... 102/312; 102/313; 102/323; 102/324; 102/333

(58) Field of Search ..... 102/312, 313, 102/323, 324, 333

(56) References Cited

U.S. PATENT DOCUMENTS 2,920,523 A * 1/1960 Barco eta l. ..... 102/313 X
3,134,437 A * 5/1964 Karpovich ..... 102/313 X
3,954,058 A * 5/1976 Sanders et al. ..... 102/333
4,382,410 A * 5/1983 Bowling et al. ..... 102/313 X
4,572,075 A * 2/1986 Day et al. ..... 102/323 X
4,913,233 A * 4/1990 Fitzgibbon, Jr. ..... 102/313 X
5,259,316 A * 11/1993 Nelson et al. ..... 102/313 X
5,551,344 A * 9/1996 Couet et al. ..... 102/313 X
5,900,578 A * 5/1999 Wathen ..... 102/313
6,165,297 A * 12/2000 Smith et al. ..... 102/313 X
6,330,860 B1 * 12/2001 Kang ..... 102/324 X
6,386,111 B1 * 5/2002 Shann ..... 102/333

OTHER PUBLICATIONS

"Numberical Modelling of the Effects of Air Decking/Decoupling in Production and Controlled Blasting" by Liu et al., *Rock Fragmentation by Blasting,* Mohanty (Ed.) ISBN 90 5410 824X, pp. 319–330.

"Ground Vibration from Single–Hole Cast Blasts" by Yang et al., *The Journal of Explosives Engineering,* Mar./Apr. 1999, pp. 37–41.

Advertisement for Vari–Stem of St. Louis, Missouri for "Greater Rock Fragmentation, Less Cost", *The Journal of Explosives Engineering,* Jul./Aug. 1999, p. 22.

* cited by examiner

*Primary Examiner*—Peter A. Nelson
(74) *Attorney, Agent, or Firm*—Sheridan Ross P.C.

(57) ABSTRACT

Disclosed herein is a rock blasting method using air bladders embedded in explosives. The rock blasting method includes the step of drilling a plurality of loading holes into a rock to predetermined depths in a predetermined arrangement. Thereafter, the loading holes are loaded with a plurality of initial explosives, a plurality of primers and a plurality of explosives in such a way that one or more air bladders are inserted into each of the loading holes and surrounded by the explosives. Thereafter, the loading holes are stemmed with stemming materials in the portions of the loading holes situated over the explosives. The primers are detonated so that the initial explosives and explosives are blown up. Hence, the loading lengths of the explosives are increased in proportion to the lengths of the air bladders so that a projection area formed on the free face of the rock is increased.

7 Claims, 12 Drawing Sheets

- PRIOR ART -

- PRIOR ART -

- PRIOR ART -

ROCK BLASTING METHOD USING AIR BLADDERS EMBEDDED IN LOADING LAYERS

The present application is a continuation-in-part of U.S. patent application Ser. No. 09/512,192 having a filing date of Feb. 24, 2000 and now U.S. Pat. No. 6,330,860, which is incorporated herein by reference in its entirety.

BACKGROUND OF THE INVENTION

1. Field of the Invention

The present invention relates to a rock blasting method, in which one or more air bladders each having a diameter less than that of a loading hole are embedded in loading holes, so the explosive power of explosive is uniformly distributed over a rock due to an increase in the specific surface area of blasting, thereby reducing blasting vibration and noise, the loading length of explosive is increased by an amount corresponding to the volumes of the air bladders, thereby increasing a projection area toward the free face of the rock, and the amount of explosive consumed is decreased by an amount corresponding to the volumes of the air bladders, thereby conserving explosive.

2. Description of the Prior Art

For conventional rock blasting methods widely used, there are a general rock blasting method in which a rock is blasted with a blasting hole stemmed with a stemming material after the blasting hole is loaded with an explosive, a deck loading type blasting method in which a rock is blasted with explosives and stemming materials alternately arranged in a blasting hole, and a pre-splitting blasting method for smoothing a tangential surface.

Of the conventional rock blasting methods, in the general blasting method, blasting is carried out, with initial explosives 2 and primers 3 and ANFO or bulk explosives 4 being loaded in loading holes 1 and the loading holes 1 being stemmed by stemming materials 5. However, in this conventional rock blasting method, the initial explosives 2 are concentrated in the lower portions of the loading holes 1, so blasting vibration and noise are great, a small rock may fly to the outside, an excessive number of boulders are produced due to the relatively longer length of each stemming material 5 and weak explosive power applied, and the explosives are excessively consumed due to the excessive use of explosives.

In order to solve the problems of the conventional blasting method, a deck loading type blasting method, as depicted in FIG. 1A, was proposed. By the deck loading type blasting method, a rock is blasted with a blasting hole 1 loaded with an initial explosive 2, a primer 3 and an ammonium nitrate fuel oil ("ANFO") or bulk explosive 6 and with stemming materials alternately disposed between the explosives 6. In this conventional rock blasting method, blasting is carried out with a plurality of primers 3 loaded in all the loading layers and explosives sequentially detonated so as to break a rock.

The second conventional rock blasting method suffers from the problems that primers are required at a number corresponding to the number of loading layers, thereby increasing a blasting cost, it is difficult to alternately load ANFO or bulk explosives 6 and the stemming materials 7, thereby causing blasting work to be ineffective and uneconomical, and the same amount of explosive is used, thereby hardly reducing blasting vibration.

As shown in FIG. 2, the conventional rock blasting methods are problematic in that the explosion length of blasting is limited to the length of explosive in the loading hole and the length of the stemming material $\square_1$ in comparison with the length of the loading hole, so the ANFO or bulk explosive 4 is concentrated in the lower portion of the loading hole and deeply loaded in the loading hole, thereby increasing blasting vibration.

Additionally, a small rock forming portion "A" situated under the a fracture boundary line L is broken into small rocks because of strong explosive power applied thereto, while a boulder forming portion "B" situated over the fracture boundary line L is relatively large in accordance with the conventional rock blasting method and broken into boulders because of weak explosive power applied thereto. Accordingly, an additional blasting is necessary to blast the boulders, so the implementation of the conventional rock blasting method is inconvenient and requires a high cost.

In order to solve the above problems, the inventor of the present invention filed a rock blasting method using air bladders inserted into a blasting hole so as to form artificial free faces.

This conventional rock blasting method is a technique in which air bladders and explosives are alternately loaded in a loading hole. In the conventional rock blasting method, explosives contained in a container having a predetermined shape are employed, the air bladders each have a diameter equal to or slightly less than that of the loading hole, and the air bladders are inserted into the loading hole while supporting the explosives. Accordingly, this conventional rock blasting method is advantageous in that loading length of explosives is increased, so the amount of explosive consumed is reduced, blasting noise is considerably attenuated and the production of boulders can be prevented.

However, in this conventional rock blasting method, the air bladders each having a diameter equal to or slightly less than that of the loading hole are employed, so it is not easy to insert the air bladders into the loading hole because the air bladders may be ruptured while being inserted into the loading hole.

Additionally, powder-state ANFO explosives or gel-state explosives should be wrapped when the powder-state ANFO explosives or gel-state explosives are loaded in the loading hole, and the air bladders are precisely and tightly inserted into the loading hole, thereby requiring a long period of time for loading explosives and air bladders in the loading hole to carry out blasting.

Additionally, in this conventional rock blasting method, the explosives and the air bladders are vertically separated and a loading layer containing a primer explodes neighboring loading layers by a sympathetic detonation phenomenon. Accordingly, a larger amount of explosive power is concentrated on the wall of the loading hole and a small amount of explosive power is exerted on the boundary between the explosives and the air bladders. Furthermore, the neighboring loading layers are spaced apart from the loading layer containing a primer. As a result, when explosives having a low detonation speed are employed, the detonation effect is not transmitted to the neighboring loading layers, thereby causing the misfiring of explosive.

The present invention provides an improved blasting method that has other advantages as well as the advantages of the conventional rock blasting methods. That is, in the rock blasting method of the present invention, one or more air bladders each having a diameter less than that of a loading hole are embedded in loading holes, so the air bladders can be easily inserted into the loading hole, powder-state ANFO explosive or gel-state bulk explosive can be easily loaded in the loading hole, the explosive continuously and tightly fills the space between the wall of the loading hole and the air bladders to improve a sympathetic detonation function, and the explosive power of explosive is uniformly distributed over the loading hole.

Hereinafter, a "free face" designates the surface of a rock in contact with the external environment, such as air or water, and considerably affects the blasting of the rock. A blasting effect is increased depending on the number of free faces and the relative positions of the explosive and the free face. This is because the free face has no resistance and a larger amount of explosive power is exerted on the free face. A "total pressure" designates force that unit explosive exerts on a loading hole. A "specific surface area" designates the area of a rock on which explosive power is directly exerted. A "sympathetic detonation" designates a phenomenon that different explosives are detonated through a medium, such as air, water or the like, when an explosive is detonated. A "burden" designates a shortest distance between the free face of a rock and the center of an explosive.

SUMMARY OF THE INVENTION

Accordingly, the present invention has been made keeping in mind the above problems occurring in the prior art, and an object of the present invention is to provide a rock blasting method using air bladders embedded in loading layers, in which one or more air bladders each having a diameter less than that of a loading hole are embedded in one or more loading layers to form one or more artificial air layers in the loading hole, so the explosion length of blasting is increased and the explosive power of blasting is uniformly distributed over the rock and the loading hole, thereby attenuating blasting vibration and noise.

Another object of the present invention is to provide a rock blasting method, in which one or more air bladders are embedded in explosive layers, so the amount of explosive is reduced by an amount corresponding to the volumes of the air bladders, thereby conserving explosive.

A further object of the present invention is to provide a rock blasting method, in which the explosion length of the explosive is increased due to the air bladders embedded in the explosive, so the total pressure of blasting is increased due to an increase in projection area toward the free face of the rock, thereby easily breaking a rock, and the length of a stemming material is shortened, thereby considerably reducing the amount of produced boulders.

A still further object of the present invention is to provide a rock blasting method, in which the ANFO or gel-state bulk explosive in the form of powder compactly fills the loading hole, so the sympathetic detonation function of the ANFO or gel-state bulk explosive is increased, thereby preventing the misfiring of explosive.

In order to accomplish the above object, the present invention provides a rock blasting method using air bladders embedded in explosives, comprising the steps of: drilling a plurality of loading holes into a rock to predetermined depths in a predetermined arrangement; loading the loading holes with a plurality of initial explosives, a plurality of primers and a plurality of explosives in such a way that one or more air bladders are inserted into each of the loading holes and surrounded by the explosives; stemming the loading holes with stemming materials in the portions of the loading holes situated over the explosives; and detonating the primers so that the initial explosives and explosives are blown up; whereby the loading lengths of the explosives are increased in proportion to the lengths of the air bladders so that a projection area formed on the free face of the rock is increased.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

A rock blasting method using air bladders embedded in explosives in accordance with the present invention is described with reference to the accompanying drawings.

As shown in FIGS. 3 to 8, the rock blasting method using air bladders embedded in explosives includes the step of drilling a plurality of loading holes into a rock to predetermined depths in a predetermined arrangement. Thereafter, the loading holes are loaded with a plurality of initial explosives 12, a plurality of primers 13 and a plurality of explosives in such a way that one or more air bladders are inserted into each of the loading holes and surrounded by the explosives. The loading holes are stemmed with stemming materials 18 in the portions of the loading holes situated over the explosives. Finally, the primers 13 are detonated so that the initial explosives 12 and explosives are blown up.

Accordingly, the loading lengths of the explosives are increased in proportion to the lengths of the air bladders so that a projection area on the free face of the rock is increased.

Additionally, the rock blasting method of the present invention forms a blasting pattern in which the explosive power of the ANFO or gel-state bulk explosive is varied by the air bladders embedded in the explosives.

Hereinafter, the principals of the rock blasting method are described.

Figure 3:
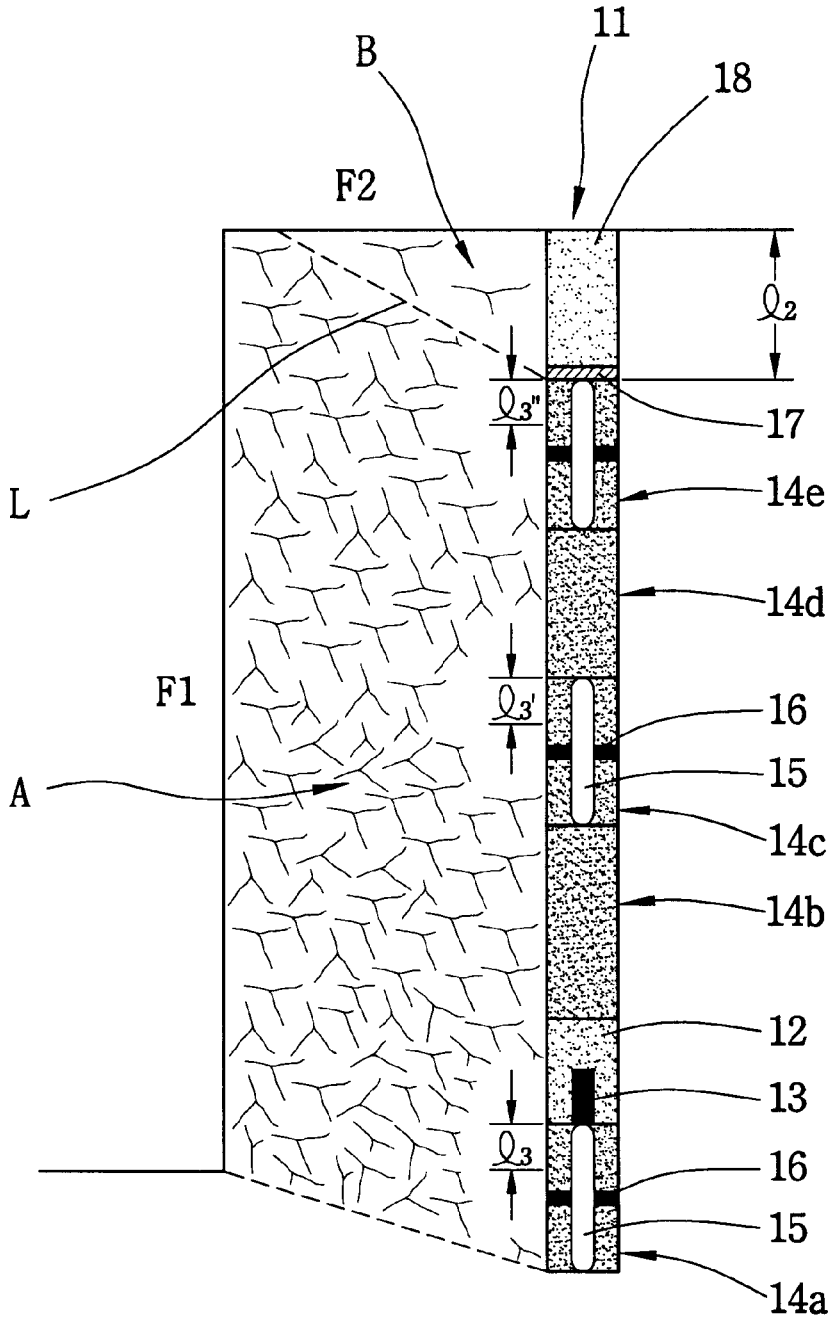
FIG. 3 is a cross section showing the principal of a rock blasting method in accordance with the present invention.

As shown in FIG. 3, a first elongated air bladder 15 having a diameter less than the diameter of a loading hole 11 is vertically placed on the bottom of the loading hole 11, with a first rubber or plastic support ring 16 fitted around the first elongated air bladder 15 being supported by the wall of the loading hole 11. A first ANFO or gel-state bulk explosive fills the space between the wall of the loading hole 11 and the outer surface of the first air bladder 15 through openings formed through the first support ring 16, thereby forming a first loading layer 14*a*. In this loading state, the first air bladder 15 is embedded in the first explosive of the first loading layer 14*a*.

Thereafter, a first primer 13 and a first initial explosive 12 are loaded over the first loading layer 14*a* and a second ANFO or gel-state bulk explosive is loaded over the first primer 13 and the first initial explosive 12, thereby forming a second loading layer 14*b*.

Thereafter, a second elongated air bladder 15 is vertically placed over the second loading layer 14*b*, with a second support ring 16 fitted around the second elongated air bladder 15 being supported by the wall of the loading hole 11. A third ANFO or gel-state bulk explosive fills the space between the wall of the loading hole 11 and the outer surface of the second air bladder 15 through openings formed through the second support ring 16, thereby forming a third loading layer 14*c*.

Thereafter, a fourth loading layer 14*d* consisting of a fourth ANFO or gel-state bulk explosive is formed over the third loading layer 14*c* in a predetermined length.

Thereafter, a third elongated air bladder 15 is vertically placed over the fourth loading layer 14*d*, with a third support ring 16 fitted around the third elongated air bladder 15 being supported by the wall of the loading hole 11. A fifth ANFO or gel-state bulk explosive fills the space between the wall of the loading hole 11 and the outer surface of the third air bladder 15 through openings formed through the third support ring 16, thereby forming a fifth loading layer 14*d*.

Thereafter, a plug 17 is placed over the fifth loading layer 14*d*, and the end portion of the loading hole 11 is stemmed with a stemming material 18.

As a result, the loading length of the first loading layer 14*a* is increased by length $\square_3$ corresponding to the volume of the first air bladder 15, so a specific surface area on which explosive power is exerted is increased in comparison with the amount of the ANFO or bulk explosive.

With the increase of the specific surface area, the explosive power of the explosives is distributed in the loading hole 11, so blasting vibration and blasting noise are attenuated. Additionally, the projection area of blasting toward the vertical free face F1 of a rock is enlarged, so the total pressure of blasting is increased, thereby easily breaking the rock.

In addition to the increase in length of the first loading layer 14*a*, the loading length of the third loading layer 14*c* is increased by length $\square_{3'}$ corresponding to the volume of the second air bladder 15, and the loading length of the fifth loading layer 14*e* is increased by length $\square_{3''}$ corresponding to the volume of the third air bladder 15.

As a result, the first, second and fifth loading layers 14*a*, 14*c* and 14*e* containing the air bladders 15 are formed, so the total loading length of the explosives is increased by length $\square_3+\square_{3'}+\square_{3''}$. Additionally, the explosive power of the explosives is distributed in the loading hole 11, and so is mainly exerted on the portion of a rock situated between the vertical free face F1 of the rock and the loading hole 11, thereby preventing the explosive power from remaining in the remaining portion of the rock and hence reducing blasting vibration considerably.

On the other hand, the loading amount of the ANFO or gel-state bulk explosives can be reduced by the amount corresponding to the total volume of the air bladders 15 because the three air bladders 15 are embedded in the first, second and third loading layers 14*a*, 14*c* and 14*e*. Consequently, the explosive power of the ANFO or gel-state bulk explosive is weakened, so the blasting vibration is attenuated.

Additionally, the total loading length of the explosives is increased by length $\square_3+\square_{3'}+\square_{3''}$, so the stemming length $\square_2$ of the stemming material 18 is shortened and the fracture boundary L of a rock is upwardly moved. Accordingly, a boulder forming area B is reduced, so the size of each boulder is decreased.

In summary, the fracture boundary L of the rock is upwardly moved toward the open end of the blasting hole 11 due to the air bladders 15 to increase the specific surface area, so the explosive power of the ANFO or bulk explosives are uniformly distributed and a larger amount of the explosive power is used to crush a rock. Accordingly, the rock blasting method of the present invention leaves a small amount of explosive power in the rock in comparison with a conventional rock blasting method, so blasting vibration is considerably reduced. On the other hand, the amount of explosives loaded in the blasting hole 11 is reduced due to the air bladders 15, so blasting vibration is also reduced.

FIGS. 4A to 4D are views showing rock blasting methods in accordance with the various embodiment of the present invention.

Figure 4A:
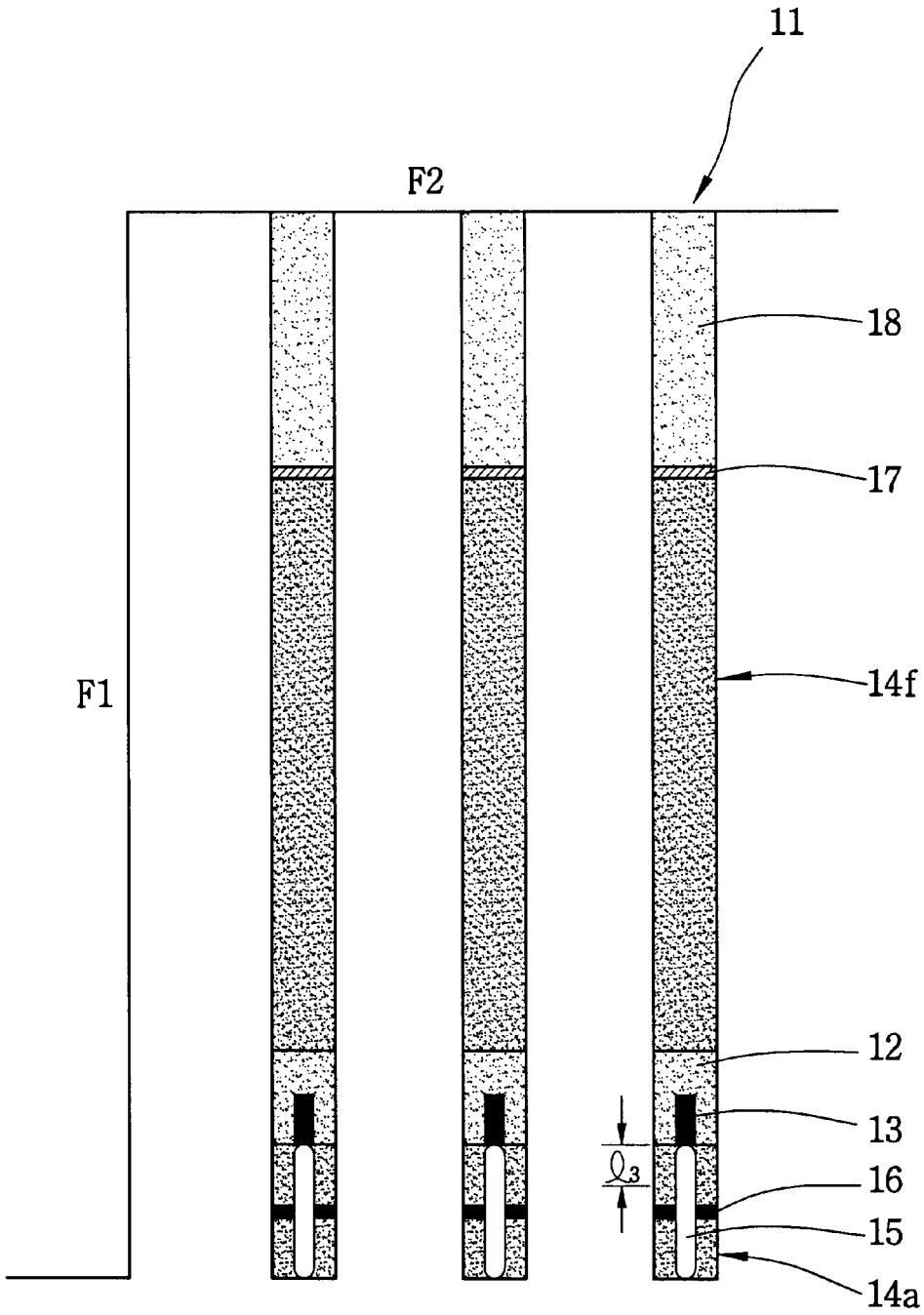
FIGS. 4A to 4D are cross sections showing embodiments in which air bladders are embedded at the various positions of loading holes.
Figure 4B:
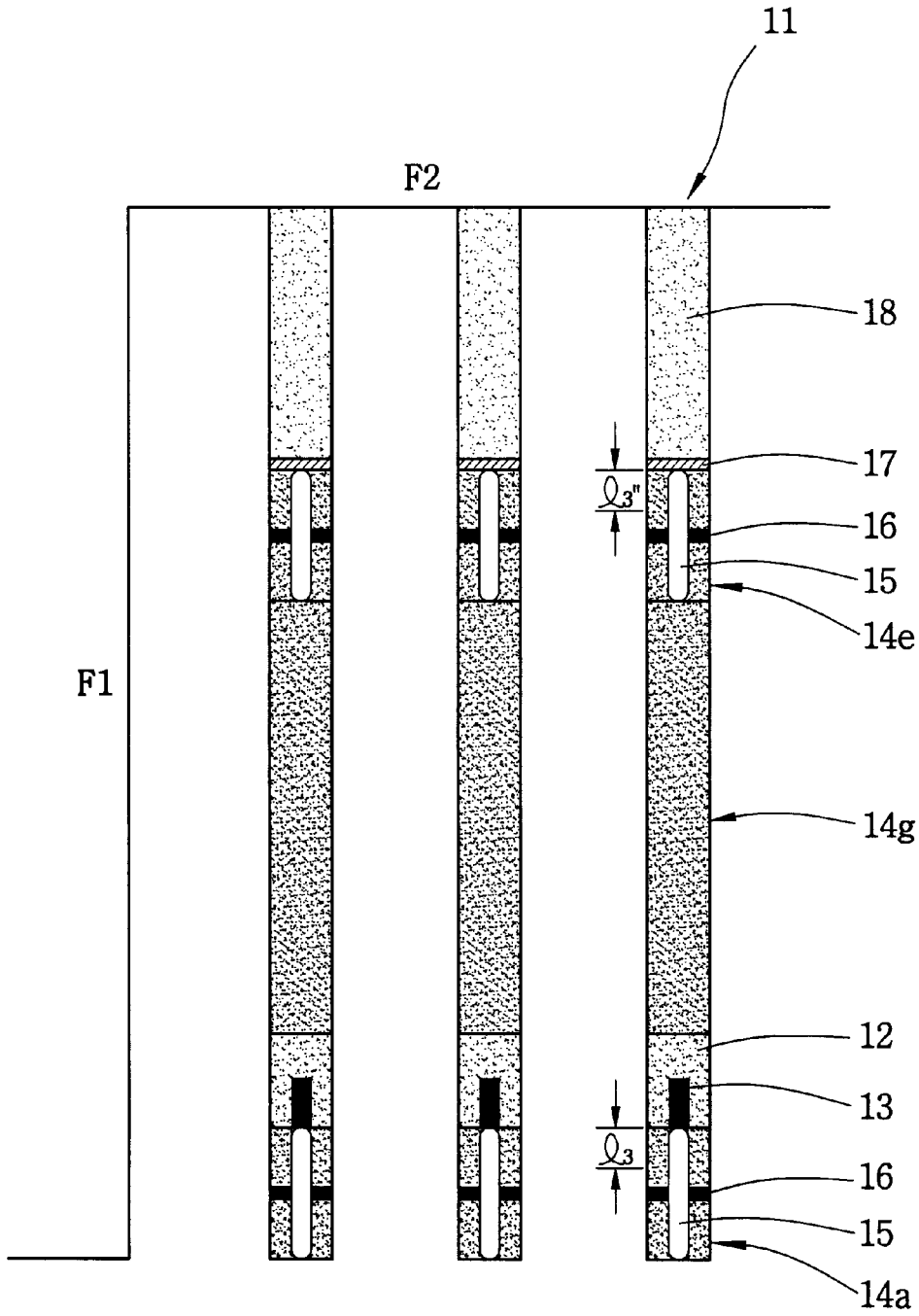
Figure 4C:
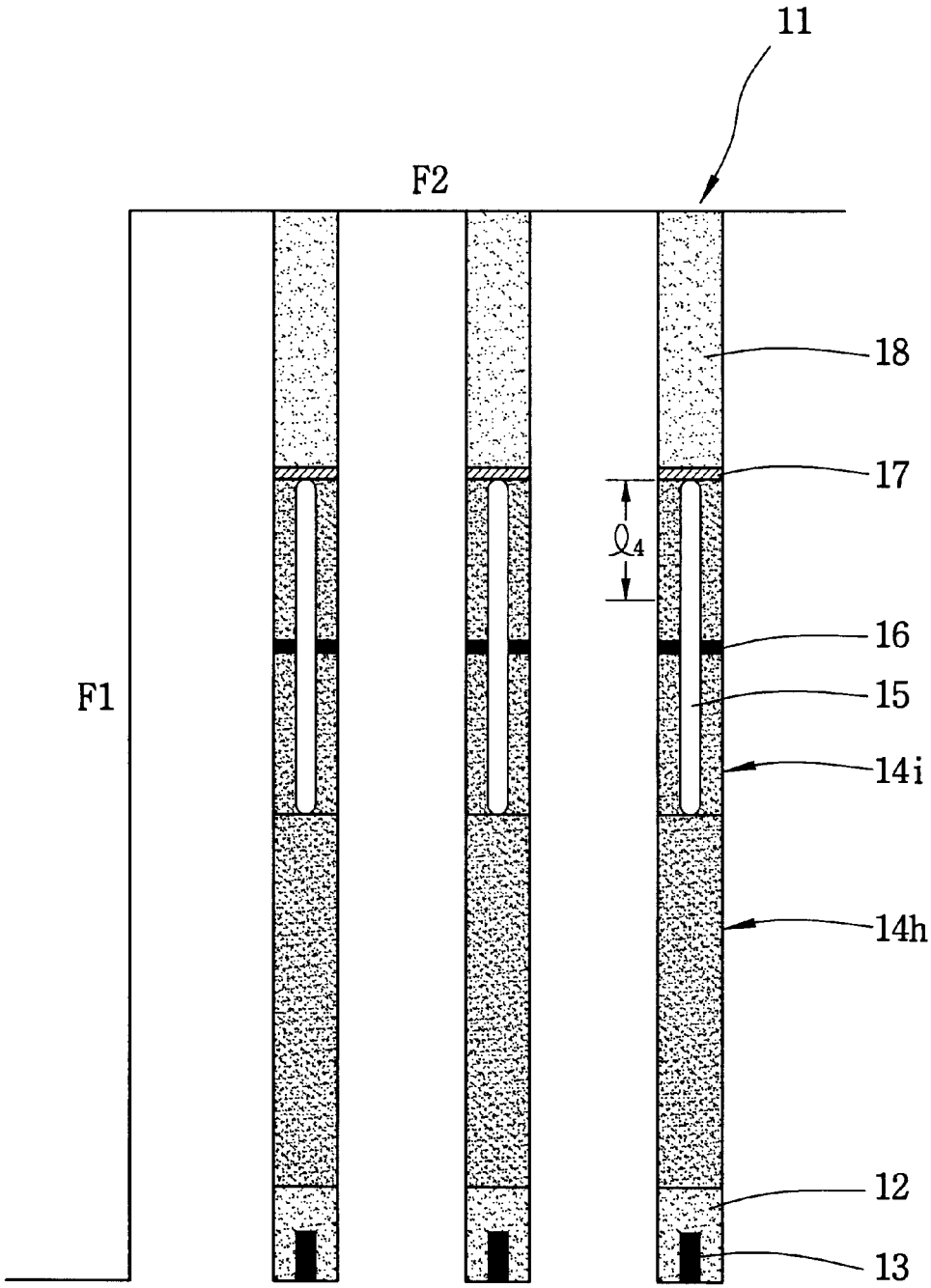
Figure 4D:
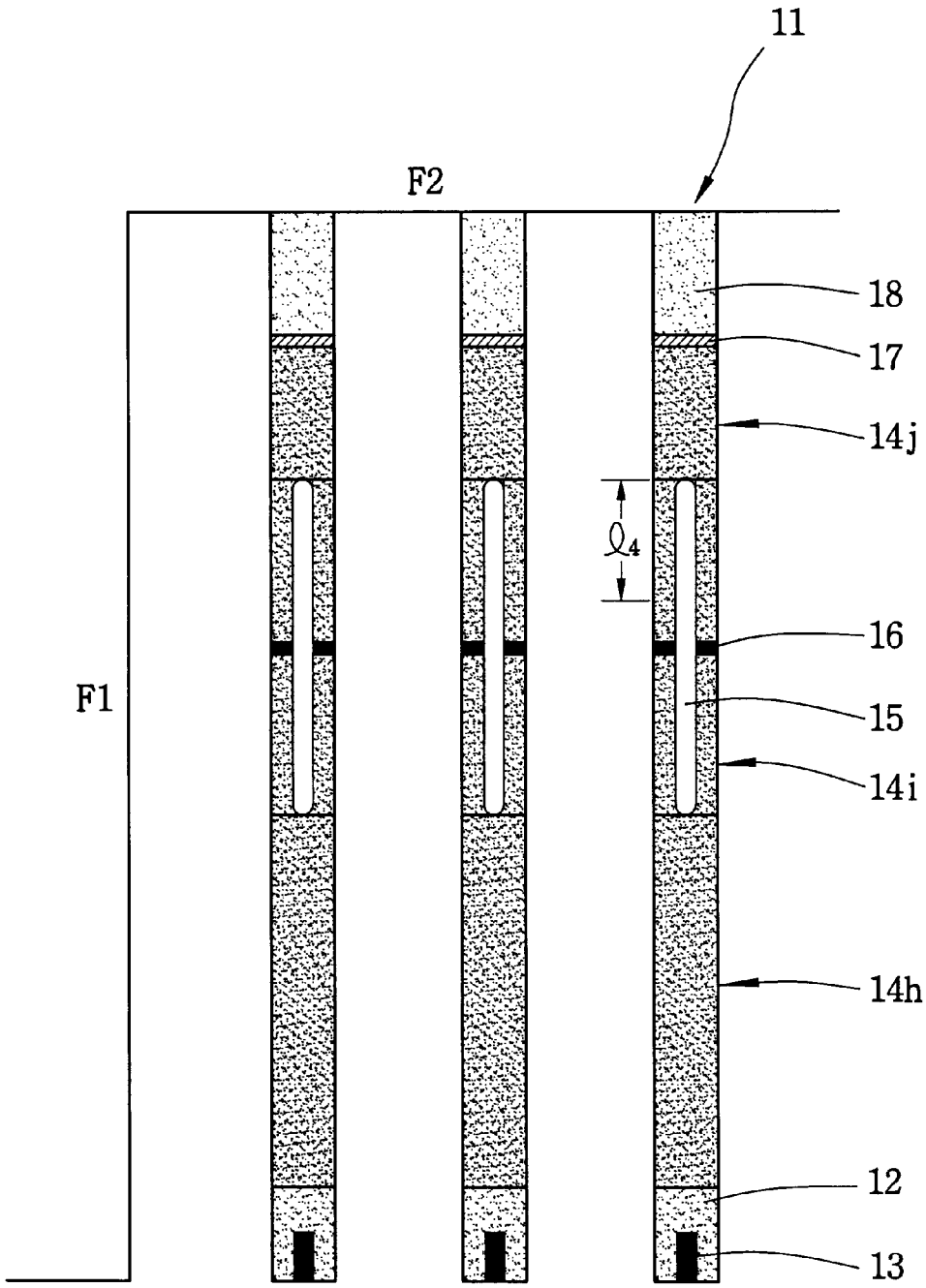

FIG. 4A is a view showing a rock blasting method, in which a loading layer in which an air bladder is embedded is formed in the lower portion of each blasting hole 11. FIG. 4B is a view showing a rock blasting method, in which two loading layers in which two air bladders are embedded are formed in the lower and upper portions of each blasting hole 11. FIG. 4C is a view showing a rock blasting method, in which a loading layer in which an air bladder is embedded is formed in the upper portion of each blasting hole 11. FIG. 4D is a view showing a rock blasting method, in which a loading layer in which an air bladder is embedded is formed in the center portion of each blasting hole 11.

The above embodiments illustrate a variety of loading patterns in which a loading layer 14*a*, 14*e* or 14*i* in which an air bladder is embedded is formed at the various portions of each blasting hole 11. In the rock blasting method shown in FIG. 4*a*, the loading length of the loading layer 14*a* containing an air bladder is increased by length $\square_3$ to increase the explosion length of the loading layer 14*a*. In the rock blasting method shown in FIG. 4*b*, the total loading length of the loading layers 14*a* and 14*e* respectively containing air bladders is increased by length $\square_3+\square_{3''}$ to increase the total explosion length of the loading layers 14*a* and 14*e*. In the rock blasting methods shown in FIGS. 4*c* and 4*d*, the loading length of the loading layer 14*i* containing an air bladder is increased by length $\square_4$ to increase the explosion length of the loading layer 14*i*.

Figure 5:
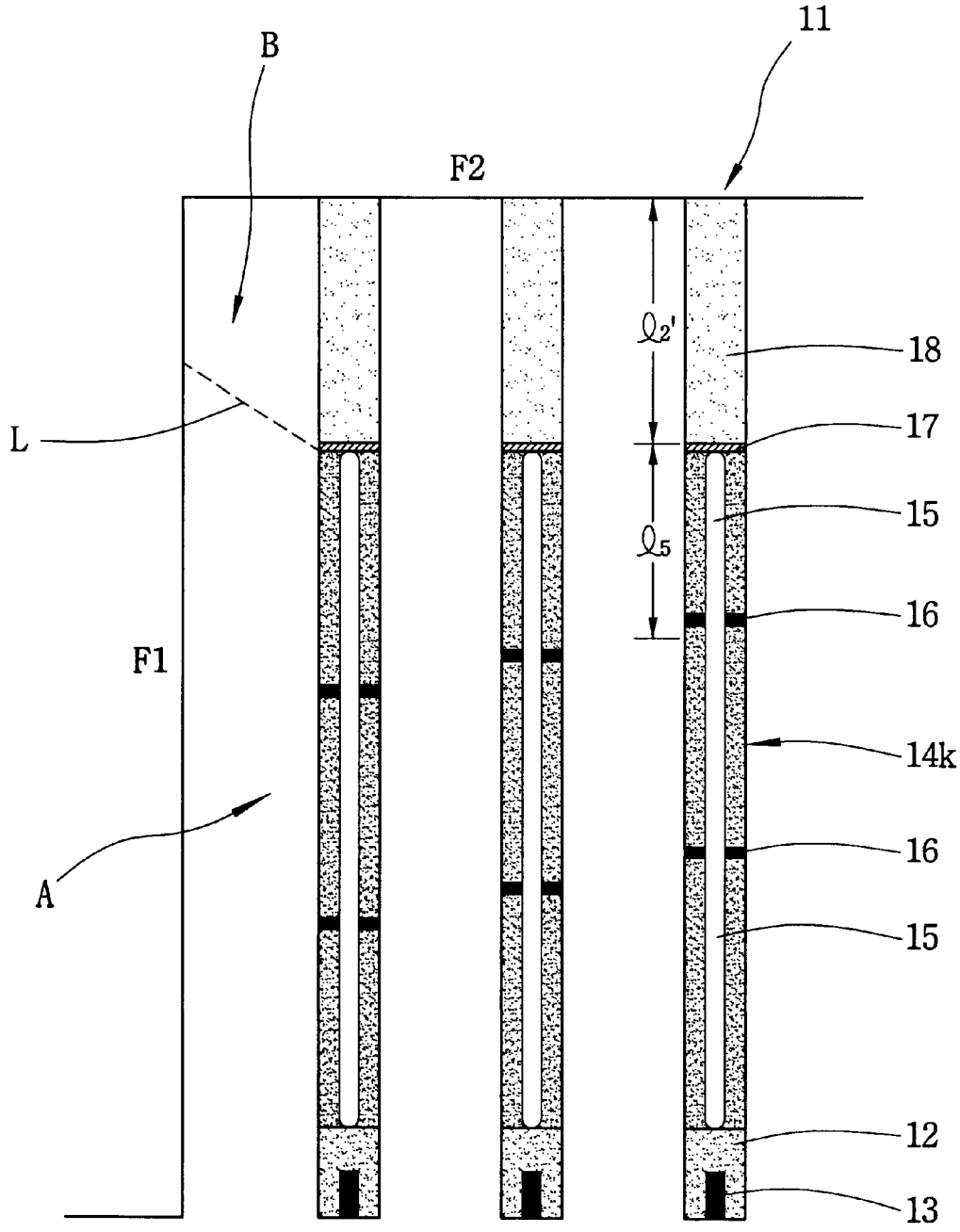
FIG. 5 is a cross section showing an embodiment in which a slender, elongated air bladder is embedded in a loading hole.

FIG. 5 is a view showing the rock blasting method in which an elongated air bladder is embedded in a loading layer. In this embodiment, a single, slender, elongated air bladder having a diameter less than the diameter of a loading hole 11 is embedded in a loading layer 14*k*, and the loading length of the loading layer 14*k* is increased by length $\square_5$, thereby increasing the explosion length of blasting.

In accordance with this embodiment, as the loading length of an ANFO explosive or a bulk explosive is increased, the stemming length $\square_{2'}$ of a stemming material can be reduced and the fracture boundary line L of a rock is upwardly moved. Accordingly, the loading layer 14*k*, in which an air bladder 15 is embedded in the ANFO explosive or bulk explosive, is situated near the horizontal free face F2 of the rock.

As a result, the fracture boundary L of the rock is upwardly moved toward the open end of the blasting hole 11 due to the elongated air bladders 15 to increase the specific surface area, so the explosive power of the ANFO or bulk explosives are uniformly distributed and a larger amount of the explosive power is used to crush a rock. Accordingly, the rock blasting method of the present invention leaves a small amount of explosive power in the rock in comparison with a conventional rock blasting method, so blasting vibration is considerably reduced. On the other hand, the amount of explosives loaded in the blasting hole 11 is reduced due to the elongated air bladders 15, so blasting vibration is also reduced.

Additionally, the ANFO or bulk explosive is loaded to the upper portion of the loading hole 11, so the stemming length $\square_2$, of the stemming material 18 is shortened and the fracture boundary L of a rock is upwardly moved. Accordingly, a boulder forming area B is reduced, so the size of each boulder is decreased.

Additionally, the ANFO or gel-state bulk explosive in the form of powders compactly fills the space around the elongated air bladder 15, so the explosive is loaded in the loading hole 11 without a discontinuous surface (layer) in the explosive, thereby preventing the misfiring of the explosive. In this case, the gap sensitivity of the blasting is increased, so the attenuation of explosive power is prevented, thereby increasing explosive power.

Figure 6:
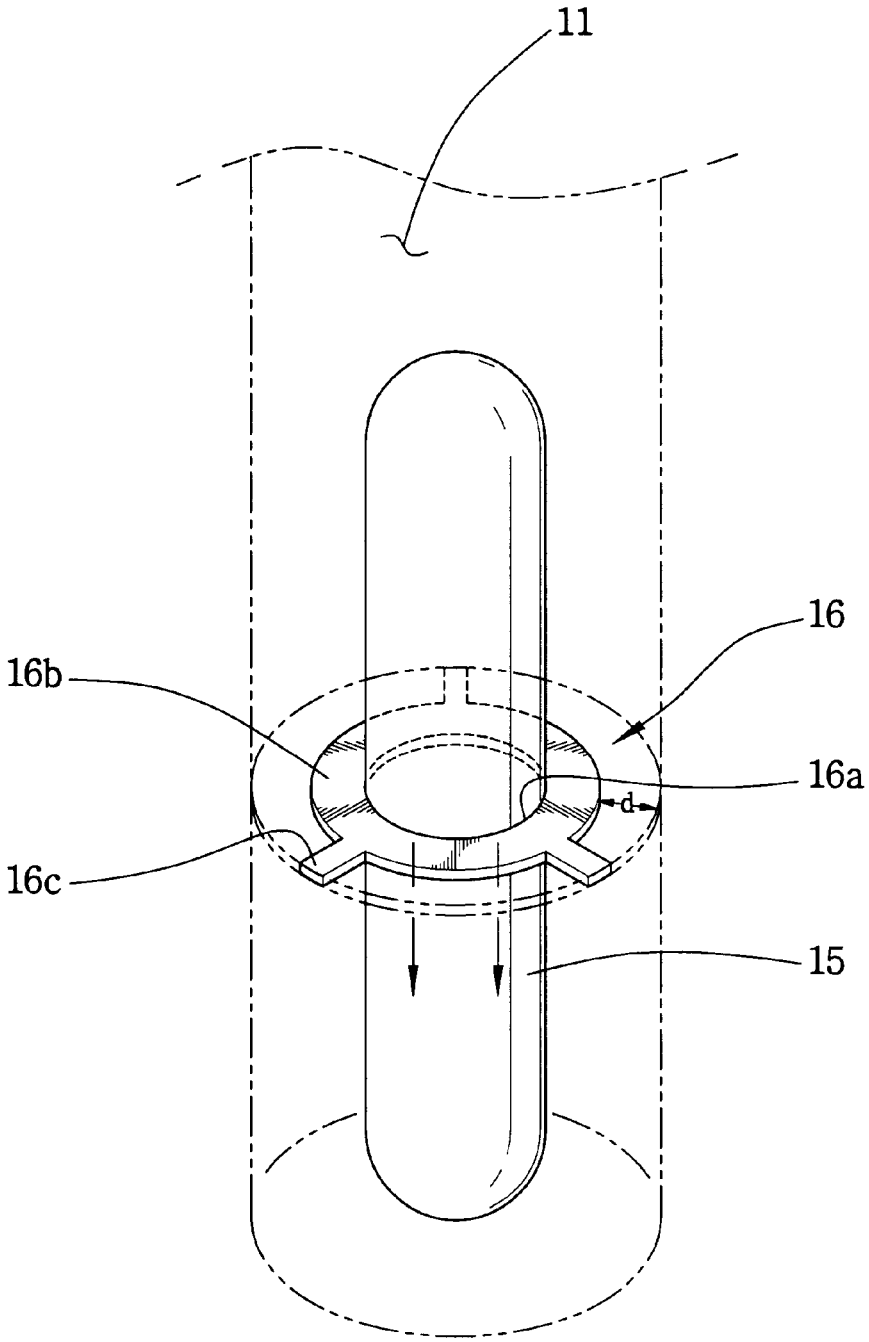
FIG. 6 is a cross section showing an embodiment in which an air bladder fitted into a bladder support is inserted into a loading hole.

As shown in FIG. 6, the support ring 16 is fitted around the air bladder 15 to situate the air bladder 15 in the center of the loading hole 11. The support ring 16 is integrally comprised of a ring portion 16*b* provided at its center portion with a center hole 16*a* for accommodating the air bladder 15 and two or more support projections 16*c* regularly spaced apart from each other, projected from the ring portion 16*b* and supported on the wall of the loading hole 11.

When the support ring 16 is supported on the wall of the loading hole 11, the peripheral edge of the ring portion 16*b* is spaced apart from the wall of the loading hole 11, thereby forming openings between the support projections 16*c*. Accordingly, the ANFO or gel-state explosive is loaded through the openings in the loading hole 11, and so continuously fills the space between the wall of the loading hole 11 and the air bladder 15.

Figure 7:
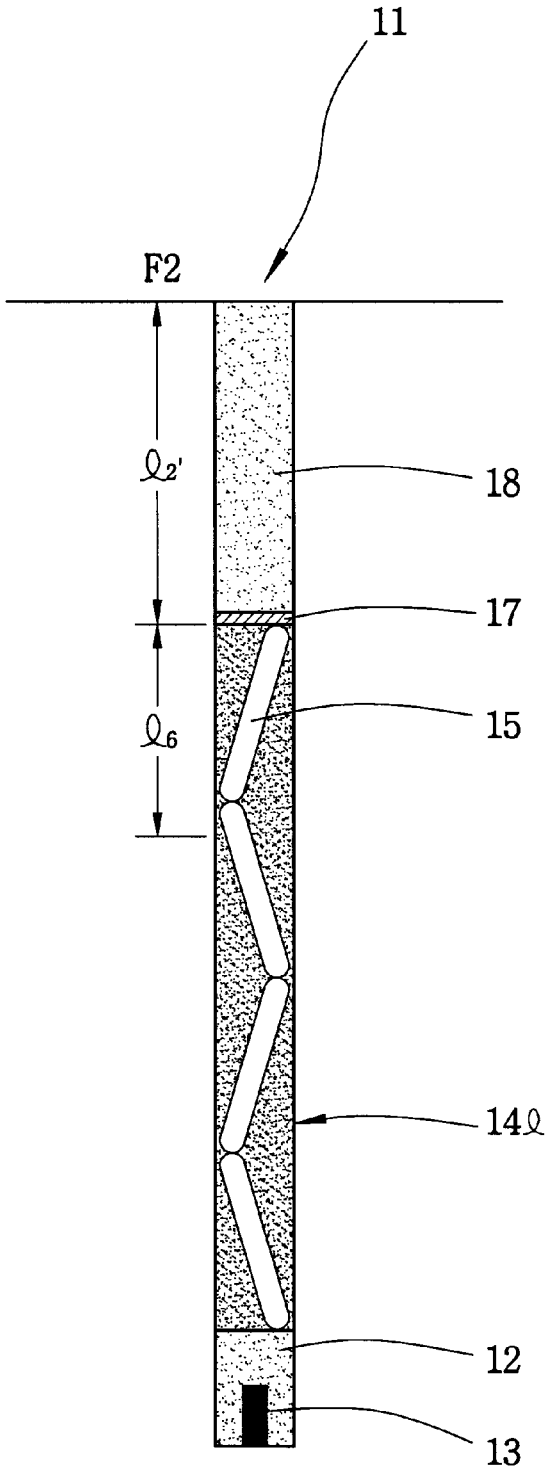
FIG. 7 is a cross section showing an embodiment in which a plurality of elongated air bladders are embedded in explosives in a zigzag arrangement.

FIG. 7 is a view showing a rock blasting method in which a plurality of air bladders are embedded in an explosive loaded in a loading hole 11 in a zigzag arrangement, each of which has a diameter less than the diameter of the loading hole 11.

In this embodiment, a plurality of air bladders 15 each having a diameter less than the diameter of the loading hole 11 are embedded in an ANFO or bulk explosive-loaded layer 14□ in a zigzag form. The loading length of the ANFO or bulk explosive is increased by length $\square_6$ corresponding to the volumes of the air bladders. The loading length of the explosive is short in comparison with the method shown in FIG. 5, thereby shortening the length $\square_2$ of the stemming material 18.

The method of this embodiment can be employed to reduce the amount of the loaded ANFO or bulk explosive that is loaded in the loading hole 11.

Figure 8:
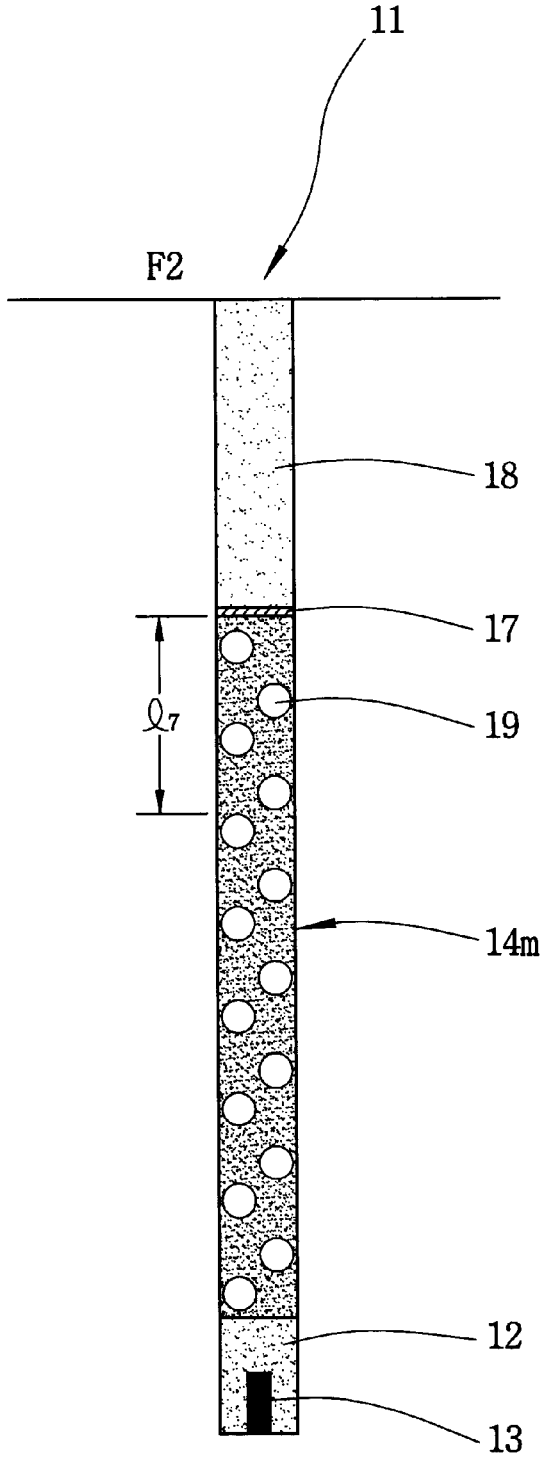
FIG. 8 is a cross section showing an embodiment in which a plurality of air balls are embedded in explosives.

FIG. 8 is a view showing a rock blasting method in which a plurality of air balls 19 are embedded in an explosive loaded in a loading hole 11.

In this embodiment, a plurality of air balls 19 each having a diameter less than the that of a loading hole 11 are embedded in the loading layer 14*m* of an ANFO or a bulk explosive loaded in the loading hole 11, so the loading length of the loading layer 14*m* is increased by length $\square_7$. The loading length of the loading layer 14*m* and the amount of an ANFO or bulk explosive to be used can be adjusted by adjusting the number of air balls 19. The area of spaces formed in the explosive are widened to its maximum in comparison with the above-described embodiments.

In this case, each of the air balls 19 is fabricated in such a way that its outer cover is formed of synthetic resin, such as vinyl, or rubber and filled with air. The air ball 19 may be formed of porous synthetic resin or rubber having a plurality of inner air holes.

As described above, the main reason why the elongated air bladders 15 or air balls 19 are embedded in the loading layer is that artificial air layers are formed in the loading layer of the ANFO or bulk explosive, so the explosion length of blasting is increased, thereby crushing the portion of a rock between the loading hole 11 and the vertical free face F1 of the rock and reducing blasting vibration.

Additionally, sealed air layers are formed using the air bladders embedded in the explosive and the explosive is uniformly distributed through the loading hole 11, so the amount of a loaded ANFO or gel-state bulk explosive per unit volume of the loading hole 11 is considerably decreased, thereby reducing the amount of explosive consumed.

As described above, since the specific surface area of blasting is increased in comparison with a decrease in the amount of a loaded explosive per unit volume, so the volume of a broken rock portion is increased and the amount of loaded explosive is decreased in comparison with the volume of the broken rock portion, thereby considerably reducing blasting vibration and blasting noise.

The stemming material 18 is generally comprised of a sand bag containing sand, and serves to block blasting noise by sealing the entrance of the loading hole 11 loaded with an explosive. The length of the stemming material 18 is directly concerned with the diameter of the loading hole 11. According to foreign experiments, the lengths of the stemming materials of 18 cm, 45 cm and 50 cm are required for the diameters of loading holes 11 of 25 cm, 50 cm and 70 cm, respectively. The length of the stemming material for the rock blasting method of the present invention may be short in comparison with that for a general rock blasting method.

The material of the air bladder 15 embedded in the loading layer formed in the loading hole 11 may be polyethylene, polypropylene, polyester or polyamide. When air is supplied through an air inlet (not shown) made of two sheets and formed at the front end of the air bladder 15, the air bladder 15 is inflated in the form of a cylinder and the sheets of the air bladder 15 are brought into tight contact with each other, resulting in sealing the bladder 15. Thereafter, the sealed bladder 15 is embedded in the loading layer. The air bladder 15 is advantageous in that its handling, such as air supply to the air bladder and insertion into the loading hole 11, is easy.

Additionally, the air bladder 15 can be mechanically manufactured, so its low manufacturing cost, its manufacturing convenience and its broad use are provided.

When air has been supplied to the air bladder 15, the diameter of the air bladder 15 is small in comparison with the diameter of the loading hole 11, so the air bladder 15 can be easily inserted into the loading hole 11. When the air bladder 15 is inserted into the loading hole 11 after being inserted into the center hole 16*a* of the support ring 16, the air bladder 15 is situated in the center portion of the loading hole 11. Thereafter, a powder ANFO or gel-state bulk explosive fills the space between the wall of the loading hole 11 and the outer surface of the air bladder 15 so that the air bladder 15 is embedded in the explosive.

In the meantime, when twenty loading holes each having a diameter of 75 mm are drilled into a rock, the bit of a drilling machine is worn. Accordingly, as the diameter of the loading hole is reduced to 65 mm, the volume of the loading hole 11 is reduced, thereby varying the length of the stemming material 18. When the lengths of the stemming materials are not constant, the degree of fragmentation of a rock is not constant. In accordance with the present invention, a difference in the length of stemming material 18 is eliminated by adjusting the length and size of the air bladder 15.

On the other hand, the degree of sympathetic detonation is determined depending on the interval between explosives and the diameter of the explosives. A general index of sympathetic detonation is calculated by the following equation:

$$\text{Index of sympathetic detonation } (n) = S/d$$

where "S" is a maximum distance (mm) and "d" is the diameter of an explosive (mm). The sympathetic detonation "n" is 2.5 in the air, and is increased in a loading hole. According to field experiments, the maximum distance S for explosives having diameters of 45 to 165 mm is 50 cm in a loading hole having the diameters of loading holes of 45 to 165 mm, thereby causing S to be 10 to 16. Accordingly, the length the air bladder 15 can be set to be 50 to 300 cm.

Additionally, loading layers with air bladders and loading layers without air bladders are alternately loaded in the loading hole and the ANFO or bulk explosives are continuously exploded, so it is not necessary to place primers 13 in all the loading layers. As a result, a blasting cost can be considerably reduced.

In the meantime, the explosives may have a powder or liquid form. The explosives may be in any state in which the air bladders are embedded in the explosives. For the primers 13, electric type primers or non-electric type primers can be employed, and any type of primers that can detonate the explosives can be employed.

Figure 1A:
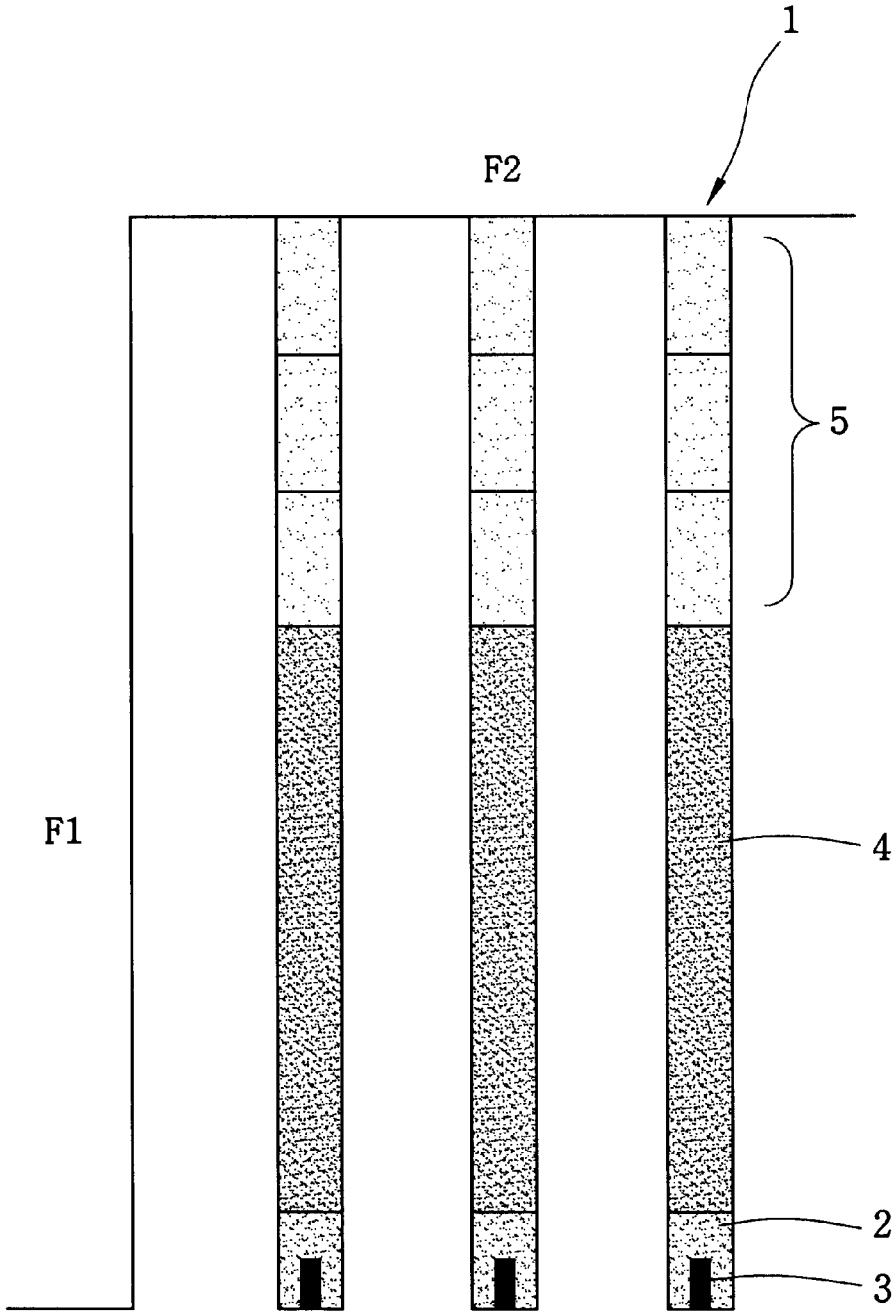
FIG. 1A is a cross section showing the conventional general loading of bulk explosives.
Figure 1B:
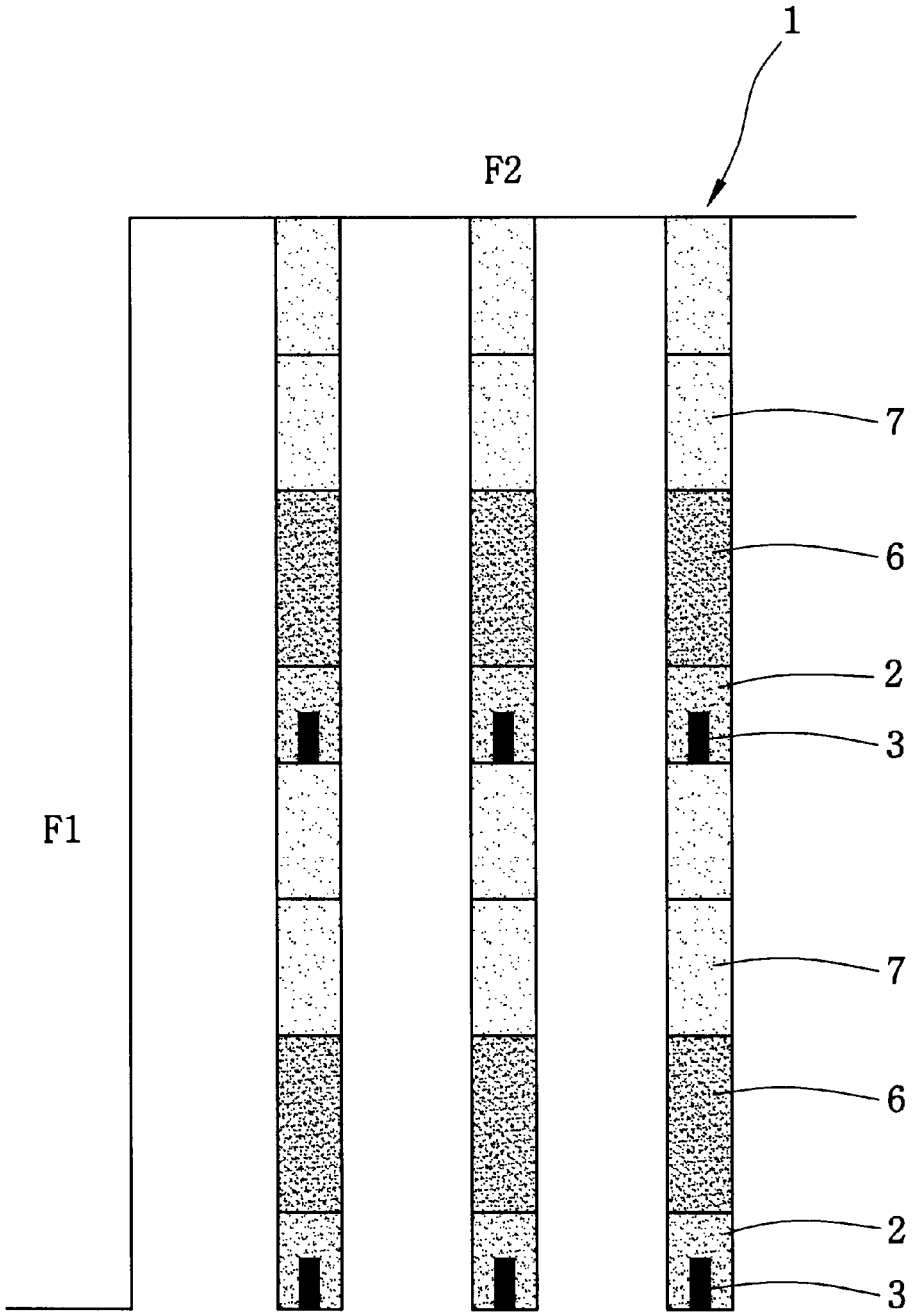
FIG. 1B is a cross section showing the conventional deck loading of bulk explosives.
Figure 2:
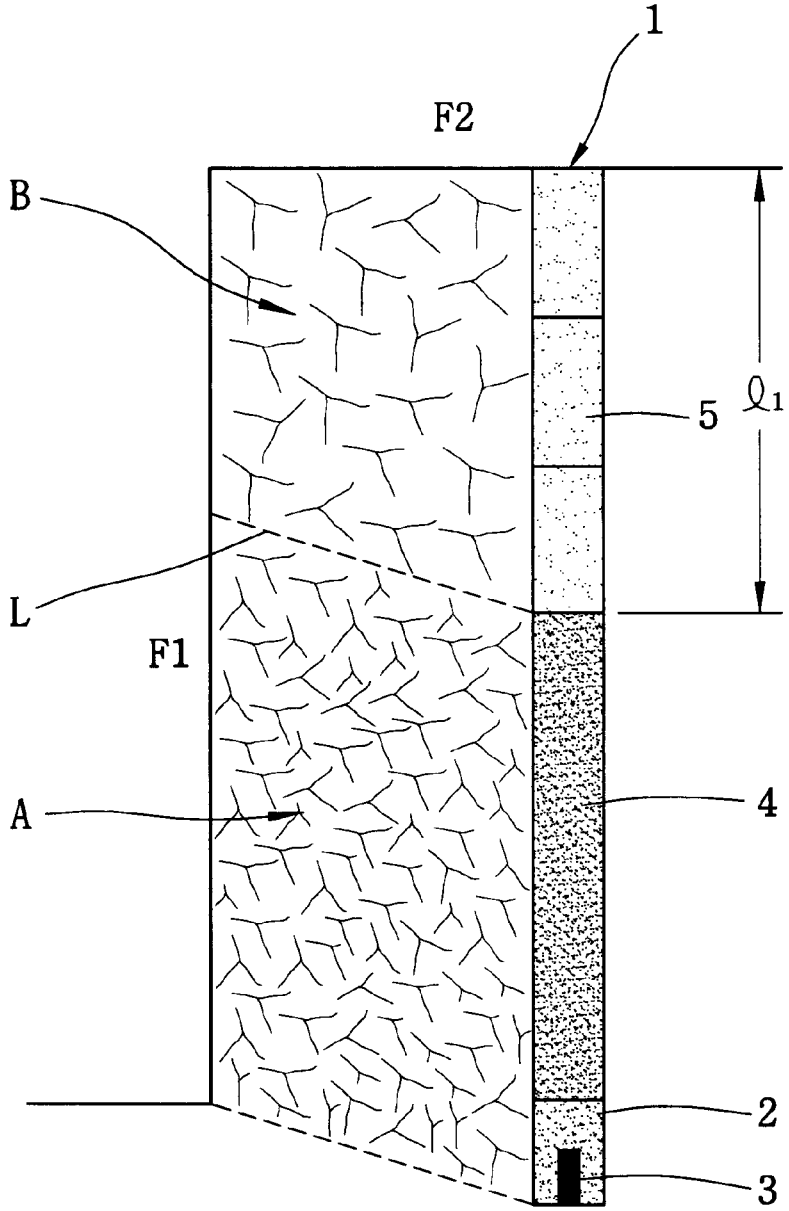
FIG. 2 is a cross section showing the principal of a conventional blasting method.

Experimental results shown in tables 1 to 14 are obtained by performing the rock blasting method of the present invention in which three air bladders are embedded in loading layers as shown in FIG. 3 and the general rock blasting method in which loading is carried out as shown in FIG. 1*a*.

Tables 1 to 8 show the specifications of blasting, blasting vibration and blasting noise in accordance with embodiments 1 to 4 in which the rock blasting method is performed using 1.0 kg of an initial explosive and 10 kg of an ANFO explosives and comparative examples 1 to 4 in which the general rock blasting method is performed using 1.0 kg of an initial explosive and 12.5 kg of an ANFO explosive.

Tables 9 to 14 show the specifications of blasting, blasting vibration and blasting noise in accordance with embodiments 5 to 7 in which the rock blasting method is performed using 1.0 kg of an initial explosive and 10 kg of an ANFO explosive and comparative examples 5 to 7 in which the general rock blasting method is performed using 1.0 kg of an initial explosive and 13 kg of an ANFO explosive.

In the above experiments, rocks are blasted by detonating primers after loading holes are drilled into rocks according to the specifications of blasting described in tables 1, 3, 5, 7, 9, 11 and 13 for the embodiments 1 to 7 and the comparative examples 1 to 7, loading is carried out as shown in FIG. 3 for the rock blasting method of the present invention and FIG. 1*a* for the general rock blasting method, primers and initial explosives are loaded, and the loading holes are stemmed by stemming materials.

Data on blasting vibration and blasting noise are compared to one another in table 2, 4, 6, 8, 10, 12 and 14.

TABLE 1

Blasting specifications of embodiment 1 and comparative example 1

| Round | Blasting type | Diameter of loading hole (m) | Hole interval (m) | Number of loading holes | Amount of loading (kg) | Number of air bladders |
|---|---|---|---|---|---|---|
| 1 | General blasting | 8.5 | 2.2 | 30 | 12.5 (1.0) | — |
| 2 | Air bladder blasting | 8.5 | 2.2 | 30 | 10.0 (1.0) | 3 |
| 3 | General blasting | 8.5 | 2.2 | 30 | 12.5 (1.0) | — |
| 4 | Air bladder blasting | 8.5 | 2.2 | 30 | 10.0 (1.0) | 3 |
| 5 | General blasting | 8.5 | 2.2 | 30 | 12.5 (1.0) | — |
| 6 | Air bladder blasting | 8.5 | 2.2 | 30 | 10.0 (1.0) | 3 |
| 7 | General blasting | 8.5 | 2.2 | 47 | 12.5 (1.0) | — |
| 8 | Air bladder blasting | 8.5 | 2.2 | 47 | 10.0 (1.0) | 3 |

1. Employed primer: non-electric primer
2. Air bladder specification: 50 mm□ × 1000 mm (three)
3. ( ): amount of explosive

TABLE 2

Blasting vibration and blasting noise according to embodiment 1 and comparative example 1

| Round | Blasting type | Maximum blasting vibration velocity (cm/sec) | Blasting noise (dB/A) | Distance from blasting source (m) |
|---|---|---|---|---|
| 1 | General blasting | 0.047 | 66.2 | 320~350 m |
| 2 | Air bladder blasting | 0.014 | 65.8 | |
| 3 | General blasting | 0.113 | 66.0 | |
| 4 | Air bladder blasting | 0.081 | 66.0 | |
| 5 | General blasting | 0.117 | 70.0 | |
| 6 | Air bladder blasting | 0.022 | 67.0 | |
| 7 | General blasting | 0.152 | 66.2 | |
| 8 | Air bladder blasting | 0.125 | 65.4 | |
| 1 | General blasting | 0.023 | 60.4 | 450~500 m |
| 2 | Air bladder blasting | N/A | N/A | |
| 3 | General blasting | 0.042 | 71.0 | |
| 4 | Air bladder blasting | 0.017 | 66.4 | |
| 5 | General blasting | 0.027 | 68.0 | |
| 6 | Air bladder blasting | N/A | N/A | |
| 7 | General blasting | 0.022 | 65.8 | |
| 8 | Air bladder blasting | 0.019 | 59.4 | |
| 1 | General blasting | 0.028 | 66.0 | 500~550 m |
| 2 | Air bladder blasting | 0.041 | 73.2 | |
| 3 | General blasting | 0.042 | 73.0 | |
| 4 | Air bladder blasting | 0.034 | 72.4 | |
| 5 | General blasting | N/A | N/A | |
| 6 | Air bladder blasting | 0.017 | 74.2 | |
| 7 | General blasting | 0.027 | 73.4 | |

TABLE 2-continued

Blasting vibration and blasting noise according to embodiment 1 and comparative example 1

| Round | Blasting type | Maximum blasting vibration velocity (cm/sec) | Blasting noise (dB/A) | Distance from blasting source (m) |
|---|---|---|---|---|
| 8 | Air bladder blasting | 0.025 | 73.8 | |

N/A: not measured

TABLE 3

Blasting specifications of embodiment 2 and comparative example 2

| Round | Blasting type | Diameter of loading hole (m) | Hole interval (m) | Number of loading holes | Amount of explosive (kg) | Number of air bladders |
|---|---|---|---|---|---|---|
| 1 | General blasting | 8.5 | 2.2 | 30 | 12.5 (1.0) | — |
| 2 | Air bladder blasting | 8.5 | 2.2 | 30 | 10.0 (1.0) | 3 |
| 3 | General blasting | 8.5 | 2.2 | 30 | 12.5 (1.0) | — |
| 4 | Air bladder blasting | 8.5 | 2.2 | 30 | 10.0 (1.0) | 3 |
| 5 | General blasting | 8.5 | 2.2 | 30 | 12.5 (1.0) | — |
| 6 | Air bladder blasting | 8.5 | 2.2 | 30 | 10.0 (1.0) | 3 |

1. Employed primer: non-electric primer (in-hole primer U400, surface primer UB 17, 42)
2. Air bladder specification: 50 mm × 1000 mm (three)
3. ( ): amount of explosive

TABLE 4

Blasting vibration and blasting noise according to embodiment 2 and comparative example 2

| Round | Blasting type | Maximum blasting vibration velocity (cm/sec) | Blasting noise (dB/A) | Distance from blasting source (m) |
|---|---|---|---|---|
| 1 | General blasting | 0.042 | 71.2 | 380~400 m |
| 2 | Air bladder blasting | 0.036 | 70.6 | |
| 3 | General blasting | 0.066 | 70.4 | |
| 4 | Air bladder blasting | 0.042 | 70.8 | |
| 5 | General blasting | 0.066 | 70.0 | |
| 6 | Air bladder blasting | 0.042 | 68.8 | |
| 1 | General blasting | 0.019 | 58.6 | 550~600 m |
| 2 | Air bladder blasting | N/A | N/A | |
| 3 | General blasting | 0.012 | 58.2 | |
| 4 | Air bladder blasting | N/A | N/A | |
| 5 | General blasting | N/A | N/A | |
| 6 | Air bladder blasting | N/A | N/A | |
| 1 | General blasting | 0.119 | 86.6 | 300~350 m |
| 2 | Air bladder blasting | 0.084 | 85.6 | |
| 3 | General blasting | 0.042 | 65.0 | |

TABLE 4-continued

Blasting vibration and blasting noise according to embodiment 2 and comparative example 2

| Round | Blasting type | Maximum blasting vibration velocity (cm/sec) | Blasting noise (dB/A) | Distance from blasting source (m) |
|---|---|---|---|---|
| 4 | Air bladder blasting | 0.042 | 68.0 | |
| 5 | General blasting | 0.076 | 84.4 | |
| 6 | Air bladder blasting | 0.082 | 84.8 | |

N/A: riot measured by a measuring instrument

TABLE 5

Blasting specifications of embodiment 3 and comparative example 3

| Round | Blasting type | Diameter of loading hole (m) | Hole interval (m) | Number of blasting holes | Amount of explosive (kg) | Number of air bladders |
|---|---|---|---|---|---|---|
| 1 | General blasting | 8.5 | 2.2 | 35 | 12.5(1.0) | — |
| 2 | Air bladder blasting | 8.5 | 2.2 | 35 | 10.0(1.0) | 3 |

1. Employed primer: non-electric primer (in-hole primer U400, surface primer UB 17, 42)
2. Air bladder specification: 50 mm × 1000 mm (three)
3. ( ) amount of explosive

TABLE 6

Blasting vibration and blasting noise according to embodiment 3 and comparative example 3

| Round | Blasting type | Maximum blasting vibration velocity (cm/sec) | Blasting vibration (dB/A) | Distance from blasting source (m) |
|---|---|---|---|---|
| 1 | General blasting | 0.143 | 71.2 | 350~370 m |
| 2 | Air bladder blasting | 0.084 | 70.6 | |
| 1 | General blasting | 0.019 | 58.6 | 480~500 m |
| 2 | Air bladder blasting | N/A | N/A | |
| 1 | General blasting | 0.098 | 68.2 | 450~470 m |
| 2 | Air bladder blasting | 0.075 | 68.2 | |

N/A: not measured

TABLE 7

Blasting specifications of embodiment 4 and comparative example 4

| Round | Blasting type | Diameter of loading hole (m) | Hole interval (m) | Number of holes | Amount of explosive (kg) | Number of air bladders |
|---|---|---|---|---|---|---|
| 1 | General blasting | 8.5 | 2.2 | 35 | 12.5 (1.0) | — |

TABLE 7-continued

Blasting specifications of embodiment 4 and comparative example 4

| Round | Blasting type | Diameter of loading hole (m) | Hole interval (m) | Number of holes | Amount of explosive (kg) | Number of air bladders |
|---|---|---|---|---|---|---|
| 2 | Air bladder blasting | 8.5 | 2.2 | 35 | 10.0 (1.0) | 3 |

1. Employed primer: non-electric primer (in-hole primer U400, surface primer UB 17, 42)
2. Air bladder specification: 50 mm × 1000 mm (three)
3. ( ): amount of explosive

TABLE 8

Blasting vibration and blasting noise according to embodiment 4 and comparative example 4

| Round | Blasting type | Maximum blasting vibration velocity (cm/sec) | Blasting vibration (dB/A) | Distance from blasting source (m) |
|---|---|---|---|---|
| 1 | General blasting | 0.073 | 64.8 | 350~370 m |
| 2 | Air bladder blasting | 0.028 | 64.8 | |
| 1 | General blasting | 0.625 | 50.0 | 130~150 m |
| 2 | Air blasting | 0.391 | 50.0 | |

TABLE 9

Blasting specifications of embodiment 5 and comparative example 5

| Round | Blasting type | Diameter of loading hole (m) | Hole interval (m) | Number of holes | Amount of explosive (kg) | Number of air bladders |
|---|---|---|---|---|---|---|
| 1 | General blasting | 8.5 | 2.2 | 35 | 13.0 (1.0) | — |
| 2 | Air bladder blasting | 8.5 | 2.2 | 35 | 10.0 (1.0) | 3 |

1. Employed primer: non-electric primer (in-hole primer U400, surface primer UB 17, 42)
2. Air bladder specification: 50 mm × 1000 mm (three)
3. ( ): amount of explosive

TABLE 10

Blasting vibration and blasting noise according to embodiment 5 and comparative example 5

| Round | Blasting type | Maximum blasting vibration velocity (cm/sec) | Blasting vibration (dB/A) | Distance from blasting source (m) |
|---|---|---|---|---|
| 1 | General blasting | 0.036 | 64.6 | 350~370 m |
| 2 | Air bladder blasting | 0.031 | 66.4 | |
| 1 | General blasting | 0.030 | 71.6 | 480~500 m |

TABLE 10-continued

Blasting vibration and blasting noise according to embodiment 5 and comparative example 5

| Round | Blasting type | Maximum blasting vibration velocity (cm/sec) | Blasting vibration (dB/A) | Distance from blasting source (m) |
|---|---|---|---|---|
| 2 | Air bladder blasting | 0.019 | 70.2 | |
| 1 | General blasting | 0.121 | 75.0 | 350~480 m |
| 2 | Air bladder blasting | 0.081 | 75.2 | |

TABLE 11

Blasting specifications of embodiment 6 and comparative example 6

| Round | Blasting type | Diameter of loading hole (m) | Hole interval (m) | Number of holes | Amount of explosive (kg) | Number of air bladders |
|---|---|---|---|---|---|---|
| 1 | General blasting | 8.5 | 2.2 | 50 | 13.0 (1.0) | — |
| 2 | Air bladder blasting | 8.5 | 2.2 | 50 | 10.0 (1.0) | 3 |

1. Employed primer: non-electric primer (in-hole primer U400, surface primer UB 17, 42)
2. Air bladder specification: 50 mm × 1000 mm (three)
3. ( ): amount of explosive

TABLE 12

Blasting vibration and blasting noise according to embodiment 6 and comparative example 6

| Round | Blasting type | Maximum blasting vibration velocity (cm/sec) | Blasting vibration (dB/A) | Distance from blasting source (m) |
|---|---|---|---|---|
| 1 | General blasting | 0.095 | 65.6 | 350~370 m |
| 2 | Air bladder blasting | 0.049 | 62.8 | |
| 1 | General blasting | 0.030 | 74.2 | 480~500 m |
| 2 | Air bladder blasting | 0.019 | 71.8 | |
| 1 | General blasting | 0.121 | 66.6 | 300~310 m |
| 2 | Air bladder blasting | 0.081 | 67.2 | |

TABLE 13

Blasting specifications of embodiment 7 and comparative example 7

| Round | Blasting type | Diameter of loading hole (m) | Hole interval (m) | Number of holes | Charge per delay (kg) | Number of air bladders |
|---|---|---|---|---|---|---|
| 1 | General blasting | 8.5 | 2.2 | 35 | 13.0 (1.0) | — |

TABLE 13-continued

| Blasting specifications of embodiment 7 and comparative example 7 | | | | | | |
|---|---|---|---|---|---|---|
| Round | Blasting type | Diameter of loading hole (m) | Hole interval (m) | Number of holes | Charge per delay (kg) | Number of air bladders |
| 2 | Air bladder blasting | 8.5 | 2.2 | 35 | 10.0 (1.0) | 3 |

1. Employed primer: non-electric primer (in-hole primer U400, surface primer UB 17, 42)
2. Air bladder specification: 50 mm × 1000 mm (three)
3. ( ): charge per delay

TABLE 14

| Blasting vibration and blasting noise according to embodiment 7 and comparative example 7 | | | | |
|---|---|---|---|---|
| Round | Blasting type | Maximum blasting vibration velocity (cm/sec) | Blasting vibration (dB/A) | Distance from blasting source (m) |
| 1 | General blasting | 0.013 | 68.6 | 300~320 m |
| 2 | Air bladder blasting | 0.084 | 68.6 | |
| 1 | General blasting | 0.456 | 71.2 | 280~300 m |
| 2 | Air blasting | 0.291 | 60.2 | |

As described above, a total of twenty rounds blasting experiments, including twelve rounds of general blasting experiments and twelve rounds of air bladder experiments were carried out. The distance between each blasting source and each measuring point was 130 m to 600 m, and the maximum charge per delay was 13.5 kg for general blasting and 11.0 kg for the air bladder blasting of the present invention.

The maximum blasting vibration velocity according to the air bladder blasting of the present invention was measured to be 0.014 to 0.391 cm/sec, a reduction of about 40 to 60% in comparison with the general blasting. The blasting noise according to the air bladder blasting of the present invention was substantially equal to or slightly less than that according to the general blasting.

Accordingly, from these data, it is seen that the blasting vibration according to the air bladder blasting of the present invention was considerably reduced in comparison with the blasting vibration of the general blasting. The degree of the fragmentation of a rock was also superior, and the amount of formed boulders was considerably reduced.

In such cases, it is assumed that the difference in blasting vibration over the rounds of blasting was dependent on distances from the blasting sources, the charge per delay, free faces, measuring positions and the conditions of rocks.

As described in table 15, in the air bladder blasting of the present invention, the air bladders are inserted in the loading hole 11, so the space occupied by the explosive is reduced, thereby reducing blasting vibration. The explosion length of blasting is increased toward the free face F2 of the rock, so the amount of formed boulders is considerably reduced, thereby increasing the effect of blasting. Additionally, the charge of explosive is reduced by at least 20%, thereby conserving explosive.

TABLE 15

| Blasting conditions and measurement results for general blasting and air bladder blasting of present invention | | | |
|---|---|---|---|
| | Blasting type | General blasting | Air bladder blasting |
| Blasting conditions | Drilling type | Hole interval burden for general blasting | Hole interval burden for general blasting |
| | Thirty blasting holes | Same | Same |
| | Charge per delay | 13.5 kg (table 1) | 11.0 kg (table 1) |
| | Charge per volume | 0.328 kg/ | 0.267 kg/ |
| | Length of air bladder | None | Table 1 |
| | Total number of primers | 30~50 | 30~50 |
| | Distance from blasting source | 130~600 m | 130~600 m |
| Measurement results | Vibration velocity | 0.047 cm/sec (table2) | 0.014 cm/sec (table 2) |
| | Blasting noise | 66.2(dB/A) (table2) | 65.8 (dB/A) (table 2) |
| | Degree of fragmentation | Inferior | Superior |
| | Variation in explosive comsumed | Same | −2.5 kg (about 20% reduction) |

In table 16, the advantages and shortcomings of the general blasting in the open air and the air bladder blasting of the present invention are compared to each other.

TABLE 16

| Comparison of advantages and shortcomings of general blasting in open air and air bladder blasting of present invention | | |
|---|---|---|
| | General blasting in open air | Air bladder blasting of present invention |
| Advantage | Easy loading | 40 to 50% reduction in blasting vibration<br>Equal or slight reduction in blasting noise<br>80% or more reduction in production of boulders<br>Decrease in implementation cost (because of 20 to 30% reduction in charge per volume and one primer saving per hole for distributed loading blasting)<br>Increase in length of explosion<br>Forming of air layer in loading hole<br>Increase in burden |
| Shortcoming | Difficulty in reducing blasting vibration and and noise<br>Difficulty in attenuating amount of boulders formed<br>Uneconomical<br>Excessive use of explosive | High fabrication cost of air bladders (however, cost may be reduced by mass-production) |

As shown in table 16, explosive is detonated to distribute explosive power in the loading hole, so the blasting vibration can be reduced. Additionally, the length of loading is increased, so the production of boulders can be reduced.

Accordingly, it can be easily understood that the air bladder blasting of the present invention is relatively economical in comparison with the conventional general blasting.

As described above, the rock blasting method of the present invention provides the below-described advantages.

First, one or more elongated air bladders each having a diameter less than the diameter of a loading hole are embedded in one or more loading layers to form one or more air layers in the loading hole, so the explosion length of explosive is increased and explosive is loaded near the free face of a rock. Accordingly, the specific surface area of blasting is increased, so the explosive power of explosive is uniformly distributed in the loading hole, thereby attenuating blasting vibration and noise.

Second, the ANFO or gel-state bulk explosive in the form of powder compactly fills the loading hole, so the sympathetic detonation function of the ANFO or gel-state bulk explosive is increased. Accordingly, the misfiring of the explosive can be prevented and the blasting vibration can be distributed into the air layers of the air bladders, thereby improving the blasting effect of the explosive.

Third, the explosion length of the explosive is increased due to the air bladder embedded in the explosive, so the projection area toward the free face of the rock is increased. Accordingly, a larger amount of explosive power is used to break the rock, so the amount of produced boulders is considerably reduced.

Fourth, the specific surface area is increased, an air layer is formed in the loading hole, and the amount of explosive consumed can be reduced by 20 to 30% or more.

In particular, in accordance with the rock blasting method of the present invention, secondary blasting is not necessary, so blasting vibration and noise due to secondary blasting can be reduced, and the cost of secondary blasting can be reduced, thereby reducing the implementation cost of blasting.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A rock blasting method using air bladders embedded in explosives, comprising the steps of:

drilling a plurality of loading holes into a rock to predetermined depths in a predetermined arrangement;

loading the loading holes with a plurality of initial explosives, a plurality of primers, a plurality of explosives and at least one air bladder in such a way that the at least one air bladder is inserted into each of the loading holes and surrounded by the explosives;

stemming the loading holes with stemming materials in the portions of the loading holes situated over the explosives; and detonating the primers so that the initial explosives and explosives are blown up; whereby the loading lengths of the explosives are increased in proportion to the lengths of the air bladders so that a projection area formed on the free face of the rock is increased.

2. The rock blasting method according to claim 1, wherein said air bladders each have a predetermined length and a diameter less than that of the loading hole, and are fabricated in the form of elongated cylinders.

3. The rock blasting method according to claim 1, wherein said air bladders each have a predetermined length and a diameter less than that of the loading hole, and are fabricated in the form of balls.

4. The rock blasting method according to claim 2, wherein said air bladders are made of polyethylene, polypropylene, polyester or polyamide.

5. The rock blasting method according to claim 2, further comprising one or more bladder supports for positioning said air bladders in the center of the loading hole and forming two or more openings, said bladder supports being fitted around each air bladder and inserted into the loading hole, together with the air bladder.

6. The rock blasting method according to claim 5, wherein said bladder supports are each and integrally comprised of a ring portion provided at its center portion with a center hole for accommodating the air bladder and two or more support projections regularly spaced apart from each other, projected from the ring portion and supported on the wall of the loading hole.

7. The rock blasting method according to claim 1, wherein said explosives are ammonium nitrate fuel oil or gel-state bulk explosives in the form of powder.

* * * * *